US006761093B2

(12) United States Patent
Chang

(10) Patent No.: US 6,761,093 B2
(45) Date of Patent: Jul. 13, 2004

(54) SOCKET STRUCTURE

(76) Inventor: Chuck Chang, No. 176-3, Guangming Rd., Taichung (TW)

( * ) Notice: Subject to any disclaimer, the term of this patent is extended or adjusted under 35 U.S.C. 154(b) by 0 days.

(21) Appl. No.: 10/282,118

(22) Filed: Oct. 29, 2002

(65) Prior Publication Data

US 2003/0154827 A1 Aug. 21, 2003

(30) Foreign Application Priority Data

Feb. 21, 2002 (TW) ..... 91202224 U

(51) Int. Cl.[7] ..... B25B 13/06
(52) U.S. Cl. ..... 81/121.1; 81/DIG. 5
(58) Field of Search ..... 81/119, 121.1, 81/124.3, DIG. 5; D8/29

(56) References Cited

U.S. PATENT DOCUMENTS 4,836,059 A * 6/1989 Arnold ..... 76/114
4,947,713 A * 8/1990 Arnold ..... 81/121.1
4,982,627 A * 1/1991 Johnson ..... 81/121.1
5,031,488 A * 7/1991 Zumeta ..... 81/180.1
5,079,978 A * 1/1992 Kupfer ..... 81/119
5,330,230 A * 7/1994 Craig ..... 283/81
5,819,606 A * 10/1998 Arnold ..... 81/124.3
6,047,618 A * 4/2000 Pieri ..... 81/121.1
6,082,227 A * 7/2000 Vogel ..... 81/119
D442,837 S * 5/2001 Porras ..... D8/29
6,257,098 B1 * 7/2001 Cirone ..... 81/119
6,282,994 B1 * 9/2001 Wei ..... 81/121.1
D477,198 S * 7/2003 Staton ..... D8/29

* cited by examiner

*Primary Examiner*—Joseph J. Hail, III
*Assistant Examiner*—David B. Thomas
(74) *Attorney, Agent, or Firm*—Rosenberg, Klein & Lee

(57) ABSTRACT

A socket structure includes a main body having an outer wall formed with a driving portion and an indication portion. The driving portion has a plurality of successively and longitudinally arranged teeth. The indication portion provides an indication and identification function, thereby facilitating a user identifying features of the socket structure. A method for manufacturing the socket structure includes the steps of: choosing material, forging, coarse grinding, broaching, turning, rolling, hardening, polishing, surface treatment, and forming the product.

9 Claims, 9 Drawing Sheets

SOCKET STRUCTURE

BACKGROUND OF THE INVENTION

1. Field of the Invention

The present invention relates to a socket structure, and more particularly to a socket structure formed with two opposite driving portions, and an indication portion located between the driving portions, wherein each of the driving portions is provided with a plurality of longitudinally arranged larger teeth and a plurality of longitudinally arranged smaller teeth arranged in a staggered manner, so as to provide different frictions, thereby facilitating the user holding the socket structure.

2. Description of the Related Art

A conventional socket in accordance with the prior art is provided with a knurl formed on the outer wall to enhance the friction of the socket, thereby facilitating the user holding the socket. However, the friction effect of the knurl is not efficient. In addition, the conventional socket does not indicate the maximum torque of the workpiece driven by the socket, so that the user cannot identify the maximum torque of the workpiece driven by the socket, so that the workpiece is easily damaged by the excessive rotation of the socket. Further, the conventional socket is made by casting, and has a smaller strength.

SUMMARY OF THE INVENTION

The present invention has arisen to mitigate and/or obviate the disadvantage of the conventional socket.

The primary objective of the present invention is to provide a socket structure formed with two opposite driving portions, and an indication portion located between the driving portions, wherein each of the driving portions is provided with a plurality of longitudinally arranged larger teeth and a plurality of longitudinally arranged smaller teeth arranged in a staggered manner, so as to provide different frictions, thereby facilitating the user holding the socket structure.

Another objective of the present invention is to provide a socket structure, wherein the indication portion is located between the two opposite driving portions, and the indication bodies and the indication zones of the indication portion are arranged in an annular manner, thereby enhancing the viewing effect of indication, and thereby facilitating the user identifying the features of the socket structure.

A further objective of the present invention is to provide a socket structure, wherein the user identifies the maximum torque of the workpiece driven by the socket structure, thereby preventing the workpiece from being excessively driven and damaged by the socket structure.

In accordance with one aspect of the present invention, there is provided a socket structure, comprising a main body having an outer wall formed with a driving portion and an indication portion, wherein:

the driving portion of the main body is formed with a plurality of successively and longitudinally arranged teeth; and the indication portion of the main body is arranged in an annular manner to provide an indication and identification function, thereby facilitating a user identifying features of the socket structure.

In accordance with another aspect of the present invention, there is provided a method for manufacturing a socket structure, comprising the steps of:

choosing material: choosing a hollow cylinder made of steel material;

forging: forging the hollow cylinder into a blank;

coarse grinding: coarse grinding the outer periphery of the blank;

broaching: performing a broaching process on the outer periphery of the blank by a plurality of broaches to integrally form larger teeth and smaller teeth on the outer periphery of the blank;

turning: performing a turning process on a mediate portion of the outer periphery of the blank to remove the larger teeth and the smaller teeth on the mediate portion of the outer periphery of the blank, thereby forming a smooth indication portion on the mediate portion of the outer periphery of the blank and forming two driving portions on the two ends of the outer periphery of the blank;

rolling: performing a rolling process on the indication portion of the outer periphery of the blank to integrally form a plurality of indication bodies and a plurality of indication zones;

hardening: performing a hardening heat treatment on the blank to increase the hardness of the blank;

polishing: performing a polishing process on the surface of the blank;

surface treatment: electroplating, dyeing and coating the surface of the blank; and product: forming the product of the socket structure.

Further benefits and advantages of the present invention will become apparent after a careful reading of the detailed description with appropriate reference to the accompanying drawings.

DETAILED DESCRIPTION OF THE INVENTION

Figure 1:
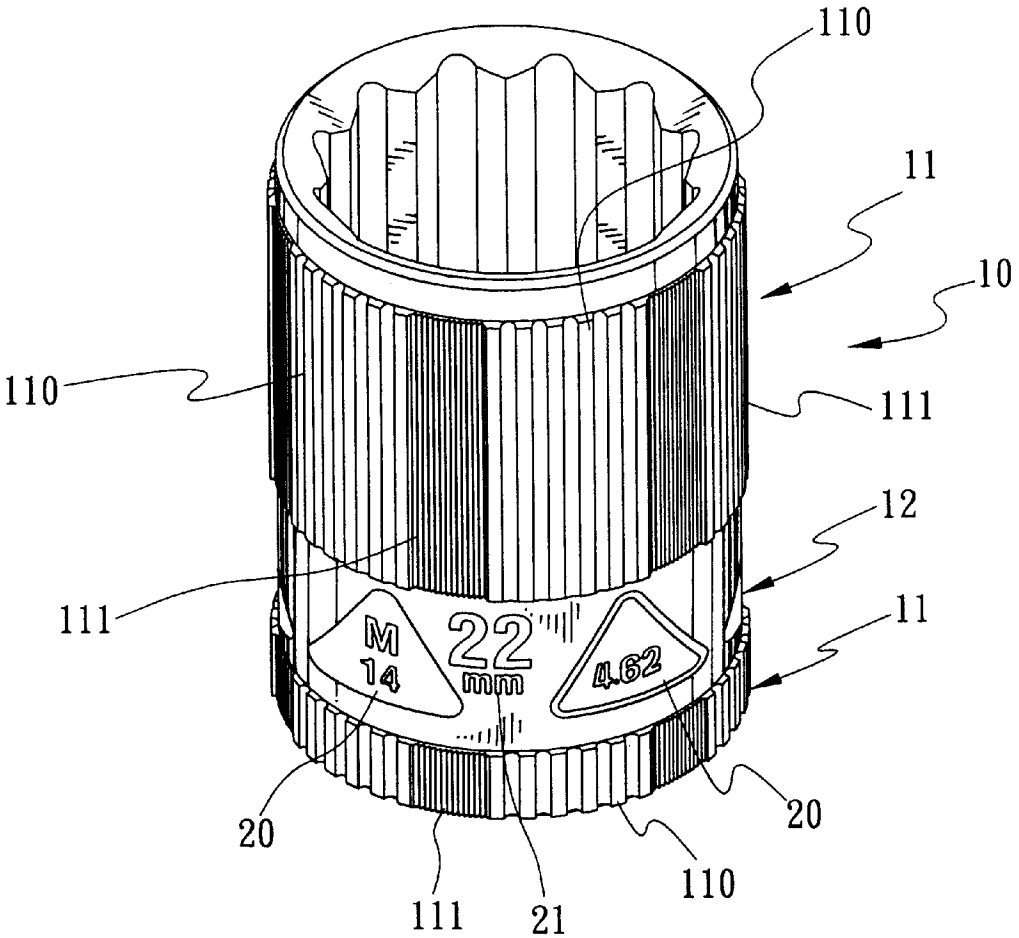
FIG. 1 is a perspective view of a socket structure in accordance with a preferred embodiment of the present invention.
Figure 2:
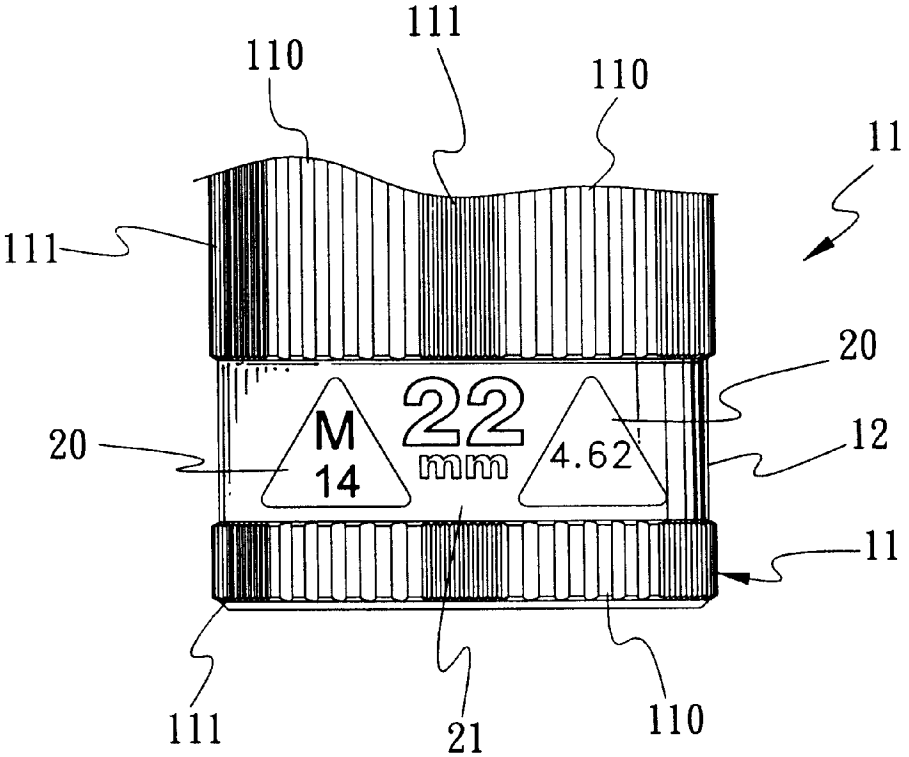
FIG. 2 is a partially cut-away plan view of the socket structure as shown in FIG. 1.
Figure 3:
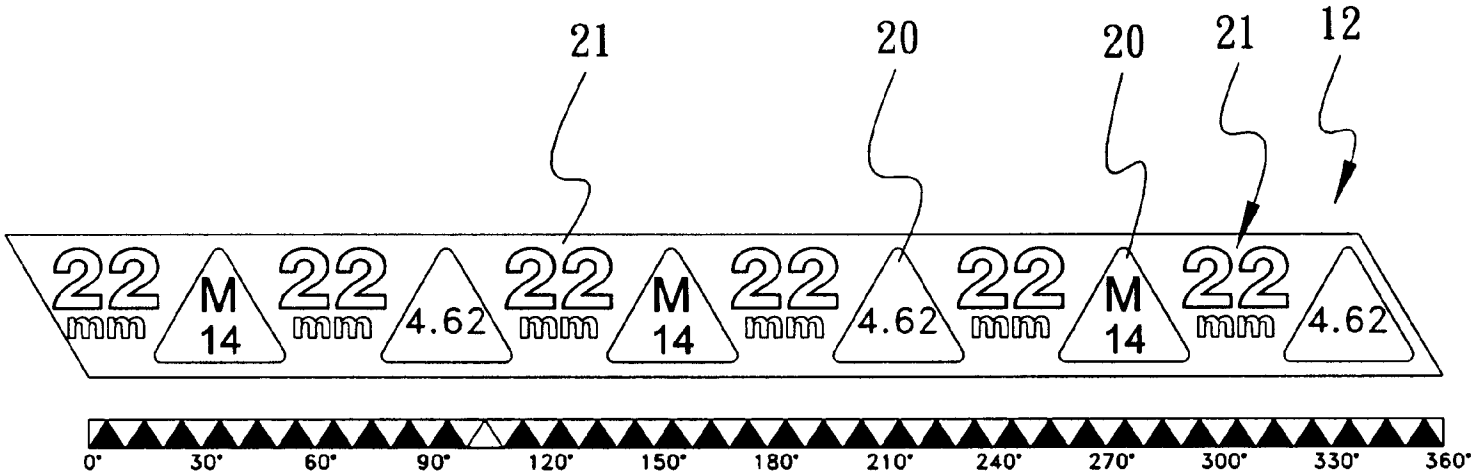
FIG. 3 is a partially plan expansion view of the socket structure as shown in FIG. 1.

Referring to the drawings and initially to FIGS. 1–3, a socket structure in accordance with a preferred embodiment of the present invention comprises a main body 10 having two ends each formed with a driving portion 11, and a mediate portion formed with an indication portion 12 located between the driving portions 11 of the two ends of the main body 10.

The driving portion 11 of each of the two ends of the main body 10 is provided with a plurality of longitudinally arranged larger teeth 110 and a plurality of longitudinally arranged smaller teeth 111. The larger teeth 110 and the smaller teeth 111 of the driving portion 11 of each of the two ends of the main body 10 are arranged in a staggered manner.

The indication portion 12 of the main body 10 provides an indication and identification function, thereby facilitating the user identifying the features of the socket structure, such as the type, size, trademark or the like. In addition, the indication portion 12 is located between the driving portions 11 of the two ends of the main body 10, thereby enhancing the viewing effect of indication.

The indication portion 12 of the main body 10 is provided with a plurality of indication bodies 20, and a plurality of indication zones 21 each located between any two adjacent indication bodies 20. Thus, the indication bodies 20 and the indication zones 21 of the indication portion 12 of the main body 10 are arranged in a staggered and equally spaced manner. Preferably, each of the indication bodies 20 of the indication portion 12 of the main body 10 has a triangular shape. Thus, each of the triangular indication bodies 20 of the indication portion 12 of the main body 10 is used to indicate the direction of the socket structure for driving the workpiece. Preferably, each of the indication bodies 20 of the indication portion 12 of the main body 10 is used to indicate the trademark of the manufacturing factory, the size of the workpiece driven by the socket structure, the maximum torque of the workpiece driven by the socket structure or the like.

Similarly, each of the indication zones 21 of the indication portion 12 of the main body 10 is used to indicate the trademark of the manufacturing factory, the size of the workpiece driven by the socket structure, the maximum torque of the workpiece driven by the socket structure or the like.

In such a manner, the user identifies the maximum torque of the workpiece driven by the socket structure, thereby preventing the workpiece from being excessively driven and damaged by the socket structure. In addition, the indication bodies 20 and the indication zones 21 of the indication portion 12 of the main body 10 are arranged in an annular manner, so that the user may view the indication marks or numbers at any angular orientations, thereby facilitating the user identifying the features of the socket structure.

Figure 4:
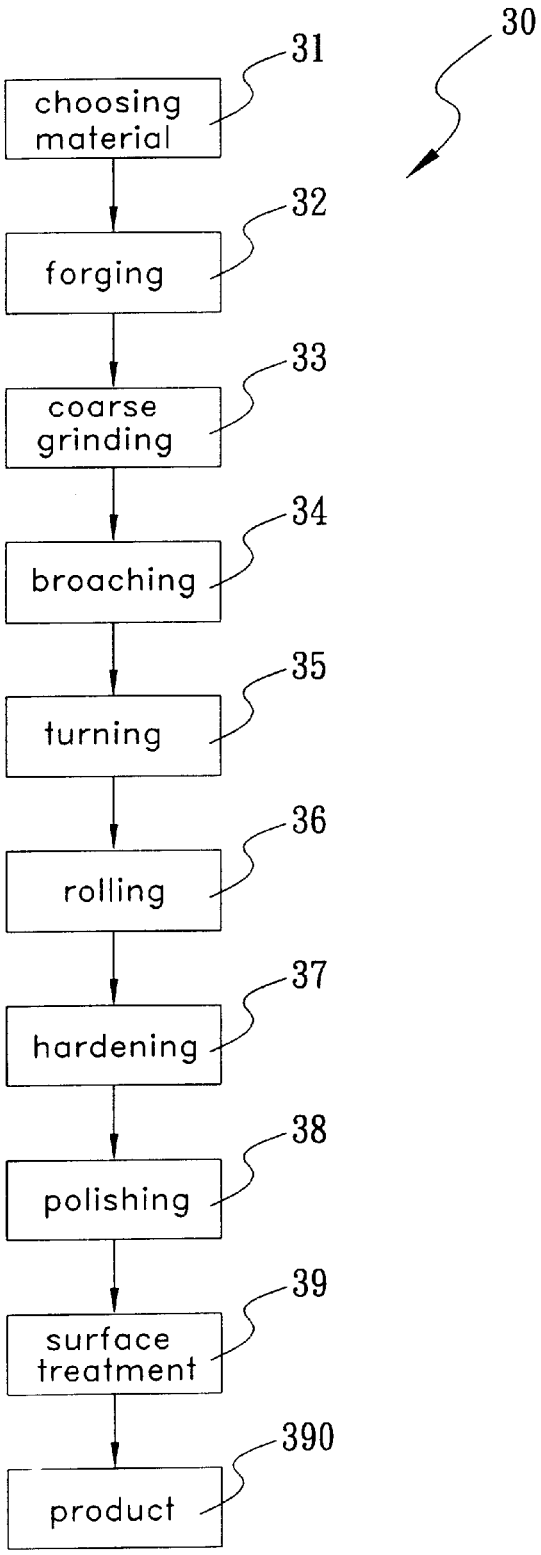
FIG. 4 is a flow chart of a method for manufacturing the socket structure in accordance with the preferred embodiment of the present invention.

Referring to FIG. 4, a method 30 for manufacturing the socket structure in accordance with the preferred embodiment of the present invention comprises the steps of:

Choosing material 31: choosing a hollow cylinder made of steel material;

Forging 32: forging the hollow cylinder into a blank;

Coarse grinding 33: coarse grinding the outer periphery of the blank;

Broaching 34: performing a broaching process on the outer periphery of the blank by a plurality of broaches to integrally form larger teeth 110 and smaller teeth 111 on the outer periphery of the blank;

Turning 35: performing a turning process on a mediate portion of the outer periphery of the blank to remove the larger teeth 110 and the smaller teeth 111 on the mediate portion of the outer periphery of the blank, thereby forming a smooth indication portion 12 on the mediate portion of the outer periphery of the blank and forming two driving portions 11 on the two ends of the outer periphery of the blank, wherein each of the two driving portions 11 includes the larger teeth 110 and the smaller teeth 111;

Rolling 36: performing a rolling process on the indication portion 12 of the outer periphery of the blank to integrally form a plurality of indication bodies 20 and a plurality of indication zones 21 each located between any two adjacent indication bodies 20;

Hardening 37: performing a hardening heat treatment on the blank to increase the hardness of the blank;

Polishing 38: performing a polishing process on the surface of the blank;

Surface treatment 39: electroplating, dyeing and coating the surface of the blank; and Product 390: forming the product of the socket structure.

Figure 5:
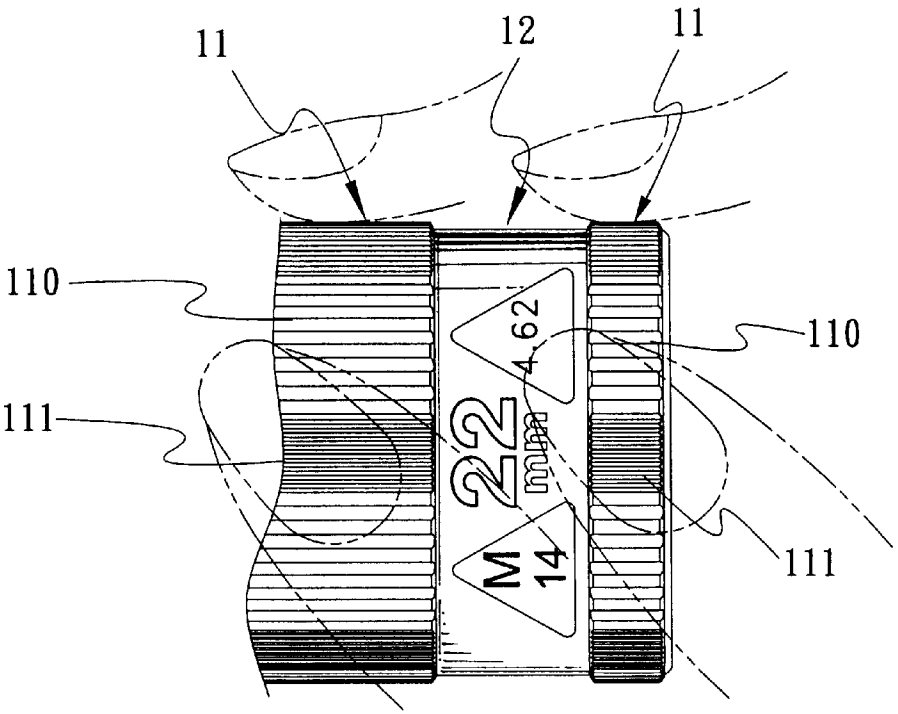
FIG. 5 is a partially cut-away plan operational view of the socket structure as shown in FIG. 1.
Figure 6:
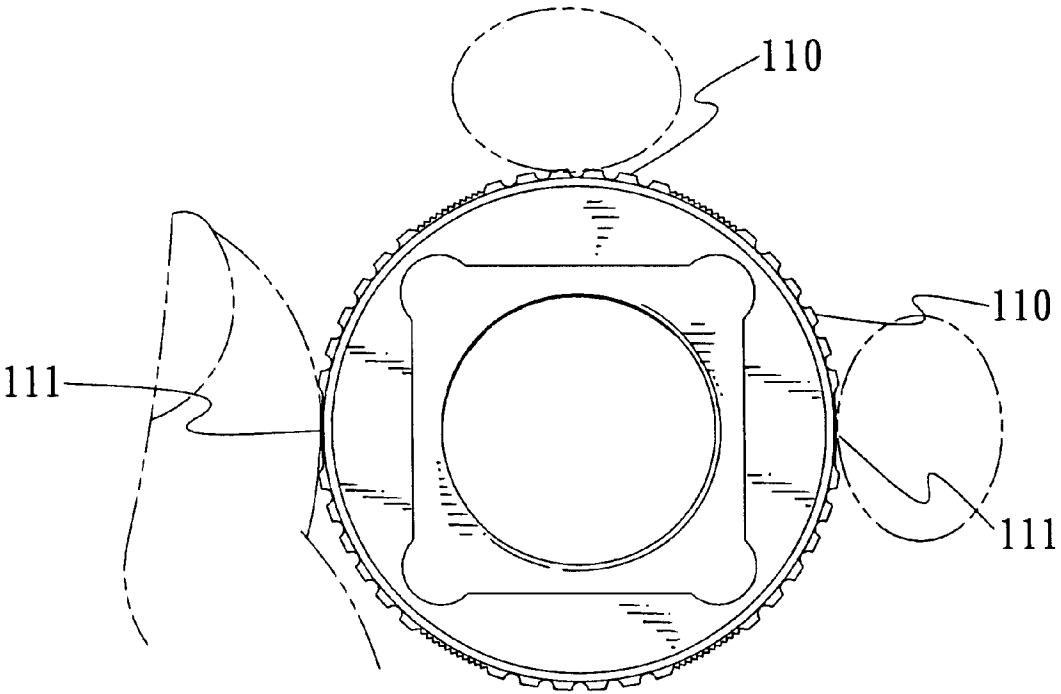
FIG. 6 is a top plan operational view of the socket structure as shown in FIG. 1.

As shown in FIGS. 5 and 6, the driving portions 11 are formed on the two ends of the main body 10, and the indication portion 12 forms a gap between the driving portions 11 of the two ends of the main body 10, so as to enhance the friction, thereby facilitating the user holding the socket structure. In addition, the driving portion 11 of each of the two ends of the main body 10 is provided with a plurality of longitudinally arranged larger teeth 110 and a plurality of longitudinally arranged smaller teeth 111 arranged in a staggered manner, so as to provide different frictions, thereby facilitating the user holding the socket structure. Further, the indication portion 12 is located between the driving portions 11 of the two ends of the main body 10, and is arranged in an annular manner, thereby enhancing the viewing effect of indication, and thereby facilitating the user identifying the features of the socket structure. Further, the indication bodies 20 and the indication zones 21 of the indication portion 12 of the main body 10 are arranged in an annular manner, so that the user may view the indication marks or numbers at any angular orientations, thereby facilitating the user identifying the features of the socket structure, and thereby facilitating the user operating the socket structure.

As shown in FIG. 1, the main body 10 of the socket structure has a constant outer diameter.

Figure 7:
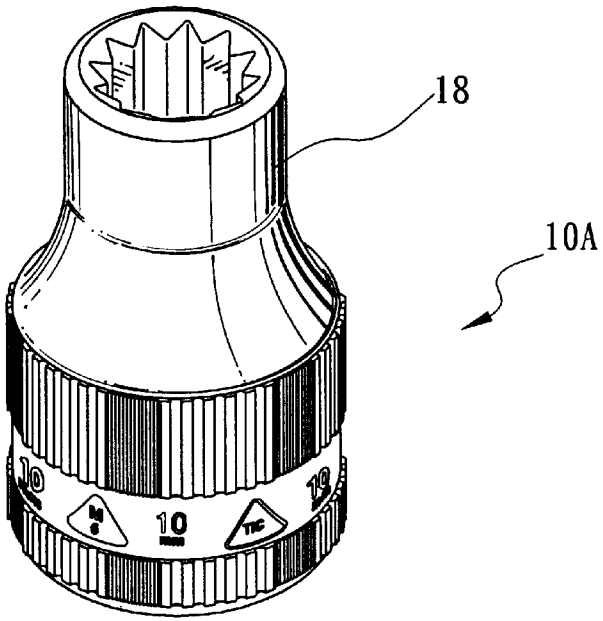
FIG. 7 is a perspective view of a socket structure in accordance with another embodiment of the present invention.

As shown in FIG. 7, in accordance with another embodiment of the present invention, the main body 10A of the socket structure has a reduced diameter neck portion 18, and has a smaller size.

Figure 8:
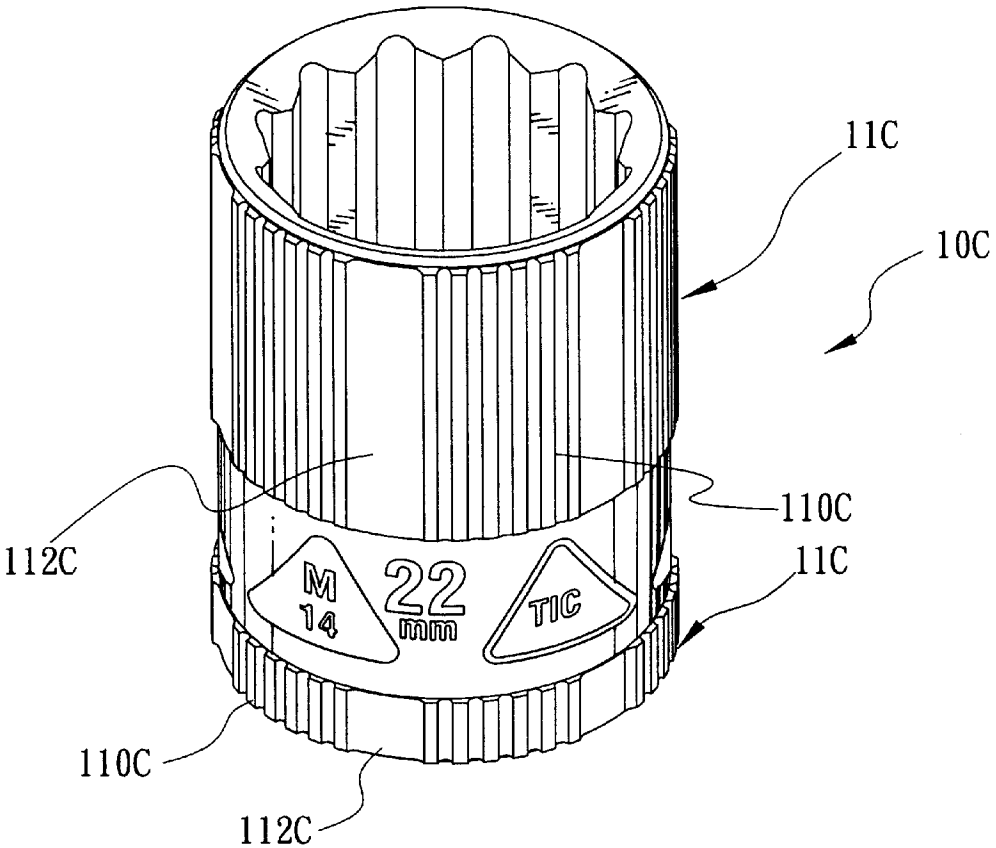
FIG. 8 is a perspective view of a socket structure in accordance with another embodiment of the present invention.

As shown in FIG. 8, in accordance with another embodiment of the present invention, the smaller teeth 111 are undefined, and the driving portion 11C of each of the two ends of the main body 10C is provided with a plurality of longitudinally arranged larger teeth 110C and a plurality of longitudinally arranged flat surfaces 112C. In addition, the larger teeth 110C and the flat surfaces 112C of the driving portion 11C of each of the two ends of the main body 10C are arranged in a staggered manner.

Figure 9:
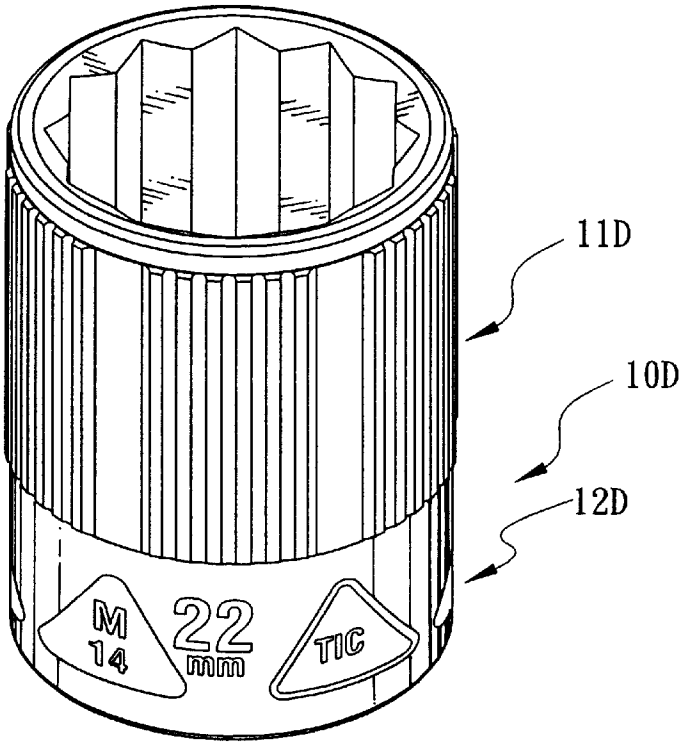
FIG. 9 is a perspective view of a socket structure in accordance with another embodiment of the present invention.

As shown in FIG. 9, in accordance with another embodiment of the present invention, the main body 10D is formed with a driving portion 11D and an indication portion 12D.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A socket structure, comprising a main body having an outer wall formed with at least one driving portion and an indication portion, wherein:

the driving portion of the main body is formed with a plurality of first and second groups of teeth, each of the plurality of first groups having a plurality of successively and longitudinally arranged first teeth, each of the plurality of first groups of teeth being disposed in angularly spaced relationship with respect to a longitudinally directed central axis of the main body, each of the plurality of second groups of teeth having a plurality of successively and longitudinally arranged second teeth, the second teeth being smaller than the first teeth, each of the second groups of teeth being disposed between a pair of adjacent first groups of teeth; and the indication portion of the main body is arranged annularly about an outer circumferential surface of the outer wall to provide an indication and identification function, thereby facilitating a user identifying feature of the socket structure.

2. The socket structure in accordance with claim 1, wherein each of two opposite ends of the main body are respectively formed with a driving portion, and the indication portion is formed on the mediate portion of the main body and is located between the driving portions of the two opposite ends of the main body.

3. The socket structure in accordance with claim 1, wherein the indication portion of the main body is provided with a plurality of indication bodies, and a plurality of indication zones each located between any two adjacent indication bodies, so that the indication bodies and the indication zones of the indication portion of the main body are arranged in a staggered and equally spaced manner, the indication bodies having a triangular shape and orientation to indicate a direction of the socket structure and have identifying indicia.

4. The socket structure in accordance with claim 3, wherein the identifying indicia of at least a portion of the indication bodies is a trademark of a manufacturing factory.

5. The socket structure in accordance with claim 3, wherein the identifying indicia of at least a portion of the indication bodies is an indication of a size of a workpiece driven by the socket structure.

6. The socket structure in accordance with claim 3, wherein the identifying indicia of at least a portion of the indication bodies is an indication of a maximum torque of a workpiece driven by the socket structure.

7. A method for manufacturing a socket structure, comprising the steps of:

choosing material: choosing a hollow cylinder made of steel material;

forging: forging the hollow cylinder into a blank;

coarse grinding: coarse grinding the outer periphery of the blank;

broaching: performing a broaching process on the outer periphery of the blank by a plurality of broaches to integrally form larger teeth and smaller teeth on the outer periphery of the blank;

turning: performing a turning process on a mediate portion of the outer periphery of the blank to remove the larger teeth and the smaller teeth on the mediate portion of the outer periphery of the blank, thereby forming a smooth indication portion on the mediate portion of the outer periphery of the blank and forming two driving portions on the two ends of the outer periphery of the blank;

rolling: performing a rolling process on the indication portion of the outer periphery of the blank to integrally form a plurality of indication bodies and a plurality of indication zones;

hardening: performing a hardening heat treatment on the blank to increase the hardness of the blank;

polishing: performing a polishing process on the surface of the blank;

surface treatment: electroplating, dyeing and coating the surface of the blank; and product: forming the product of the socket structure.

8. The method in accordance with claim 7, wherein in the turning step, each of the two driving portions includes the larger teeth and the smaller teeth.

9. The method in accordance with claim 7, wherein in the rolling step, each of the indication zones is located between any two adjacent indication bodies.

* * * * *